United States Patent [19]

Stranders

[11] 4,296,958

[45] Oct. 27, 1981

[54] HOLDER FOR LIQUID PACKAGING CONTAINERS

[75] Inventor: Roelof J. Stranders, Thalwil, Switzerland

[73] Assignee: Werner Weber Holding AB, Baar, Switzerland

[21] Appl. No.: 114,788

[22] Filed: Jan. 24, 1980

[30] Foreign Application Priority Data

Feb. 9, 1979 [CH] Switzerland ..... 1310/79
Mar. 12, 1979 [CH] Switzerland ..... 2344/79

[51] Int. Cl.[3] ..... A47B 95/02
[52] U.S. Cl. ..... 294/27 H; 16/114 R
[58] Field of Search ..... 294/27 H, 32, 31.2, 294/31 A; 16/114 R

[56] References Cited

U.S. PATENT DOCUMENTS 2,249,144 7/1941 Kleina ..... 16/114 A X
2,757,034 7/1956 Pahl ..... 294/31 A UX
3,250,562 5/1966 Frasure et al. ..... 294/31.2
3,421,789 1/1969 Klomparens ..... 294/31.2
3,610,671 10/1971 Conger ..... 294/27 H X
3,615,115 10/1971 Simms ..... 16/114 R X
3,692,346 9/1972 Simms ..... 294/31 A

*Primary Examiner*—Andrew V. Kundrat
*Attorney, Agent, or Firm*—Ladas & Parry

[57] ABSTRACT

A holder for liquid packaging containers with a closure means comprising flaps folded back against the container walls, the holder comprising a first supporting element engaging the rear container wall and fitted with a handle and a second supporting element engaging a further container wall, both elements being interconnected and forming the holder body, whereby one of said supporting elements is provided with retaining means adapted to hold a closure flap pulled away from the container wall in a substantially parallel position relative to the adjacent wall. The holder is particularly suitable for holding drink cartons.

9 Claims, 7 Drawing Figures

HOLDER FOR LIQUID PACKAGING CONTAINERS

BACKGROUND OF THE INVENTION

This invention relates to a holder, with handle, for liquid packaging containers, notably drinks cartons of the kind wherein the closure device of the package comprises folding flaps which are detachably applied to the carton walls, with a supporting part designed for application to the rear wall of the container and being provided with the handle, and with a further supporting part designed for application to a further container wall, both said supporting parts being mutually connected and forming the constituent parts of the holder body.

Holders for liquid packaging containers of the kind specified are known in various forms. Normally these holders match the shape of the container and are designed to support and hold the containers by means of lateral walls and a base, or bottom wall. In one existing arrangement the holder is further provided with a lid comprising a pouring spout which automatically penetrates into the container when the lid is closed and thus creates a pouring orifice.

This last mentioned arrangement, whilst at first glance appearing to be an ideal solution, has, however, the disadvantage of raising problems in regard to hygiene.

SUMMARY OF THE INVENTION

It is the aim of the present invention to provide a holder, with handle, which enables a conventional, rectangular box-like drinks container to be securely retained and the contents to be poured out through the usual container spout opening.

According to this invention a holder, with handle, of the kind specified is characterised in that one of the supporting parts is provided with retaining means for securely retaining the closing flap when this has been pulled away from the container walls in a substantially parallel position with the adjacent container wall.

The retaining means are preferably characterised in that they comprise a supporting element for the rear wall and a further supporting element for the upper container wall extending at right angles in the forward direction away from the first supporting element, the retaining means being designed as a slot and arranged at the junction of the two supporting elements.

According to another embodiment of this invention a holder of the kind specified is characterised in that retaining means are provided at the upper end of the rear-wall supporting element to hold the rear closing flap of the container, when pulled away from the container wall, securely in a substantially parallel position with the rear wall of the container.

Preferably the retaining means consist of a slot or slit provided at the upper end of the rear-wall-supporting element into which fits the said closing flap of the container. The actual opening of this slot is conveniently arranged at the junction between rear-wallsupporting element and handle.

BRIEF DESCRIPTION OF THE DRAWINGS

Some embodiments of the invention will be hereinafter more particularly described with reference to the accompanying drawings wherein.

DETAILED DESCRIPTION OF THE PREFERRED EMBODIMENTS

Figure 1:
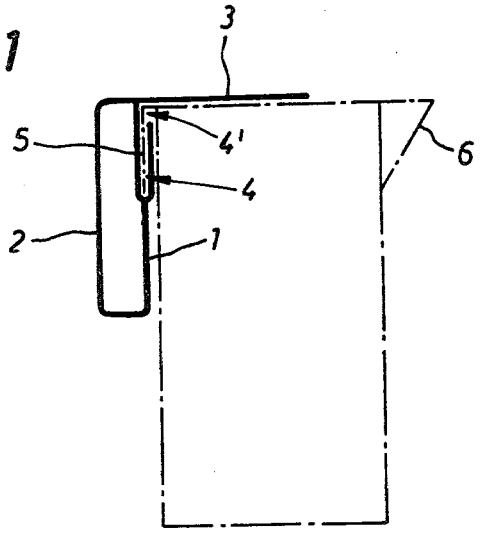
FIG. 1 is a purely schematic illustration of a holder for rectangular box-shaped drinks-packaging containers being an embodiment of this invention.

FIG. 1 in the drawings shows in a purely diagrammatical manner one example of a holder for rectangular box-shaped drinks packages, or cartons, comprising closures with the usual closing flaps folded down against the front and rear carton walls.

Figure 6:
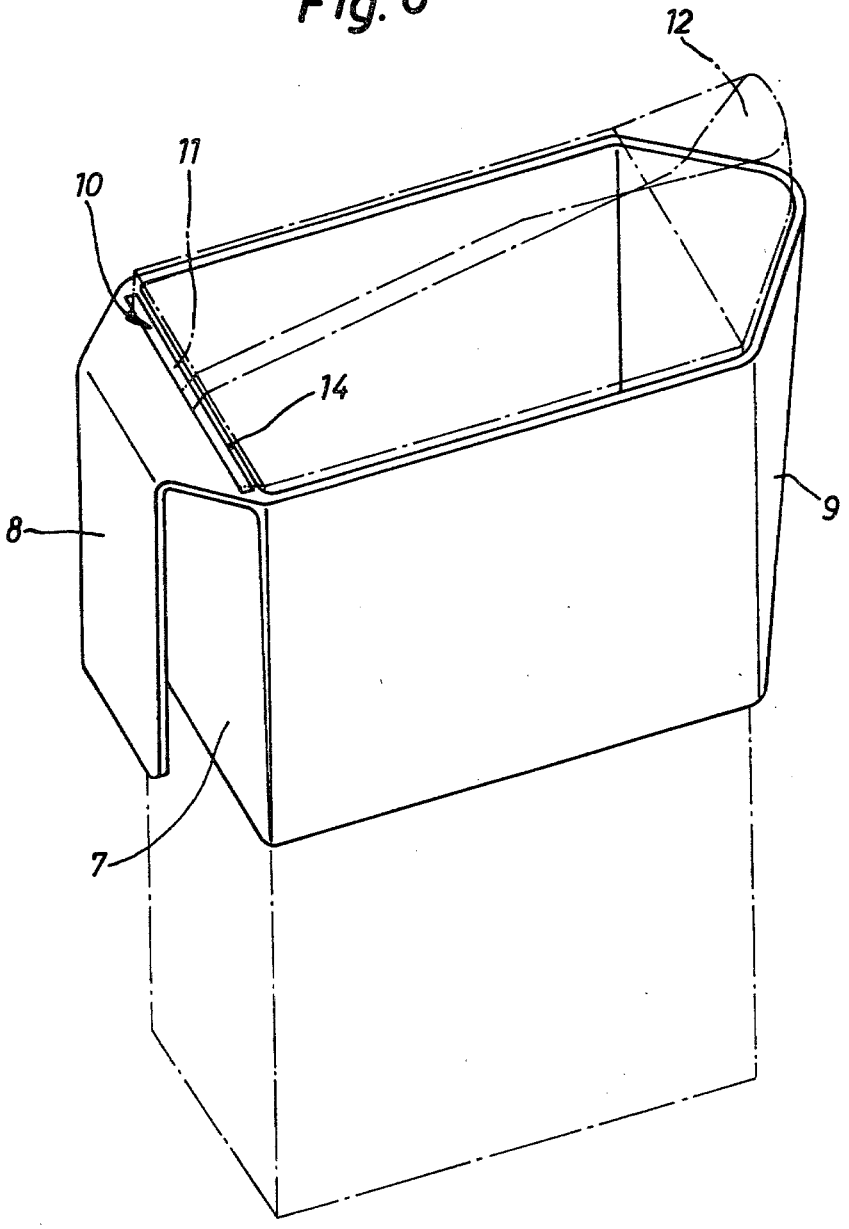
FIG. 6 is a perspective view of a preferred embodiment.

That is to say, the container package or carton is a cuboid having upstanding rectangular front and rear walls, rectangular side walls extending between said front and rear walls and rectangular top and bottom ends. The top and bottom ends are formed in conventional manner by folding over the upper and lower margins of the side, front and rear walls. These folded margins constitute flaps which, in the folded and hence closed positions, overlap one another to form sealed top and bottom ends of the package or carton. In a similarly conventional manner, the infolded flap formed by the upper margin of the front wall is shaped in such manner that it may be raised from its closed position in which it lies flush in overlapping relationship with the folded upper margins of the side walls and "pinched" to form a pouring spout. Such a closure is well known and is best illustrated schematically in FIG. 6 of the drawings to be discussed in detail hereinafter. Also to be subsequently discussed in detail is the manner in which, again as best illustrated in FIG. 6, the similarly shaped infolded upper margin of the rear wall may be raised from the closed overlapping position and folded in the reverse direction to engage and retain the carton holder.

As will be seen from the drawing, the holder comprises a rear-wall-supporting element 1, a handle part 2 rigidly connected or formed integrally with this element 1, and a supporting element 3 for the upper container wall. At the upper end of the rear-wall supporting element 1, and more specifically on the inside thereof, there is formed a slit-or slot-like recess 4 into which the flap 5 (dotted lines) can be inserted when it has been slightly pulled away from the container wall. With this basic construction a secure and firm hold of the container in the holder is guaranteed and the liquid contents can be readily poured out through the opened spout flap 6. The container can be readily tilted right down to a horizontal position without falling out of the holder.

Figure 2:
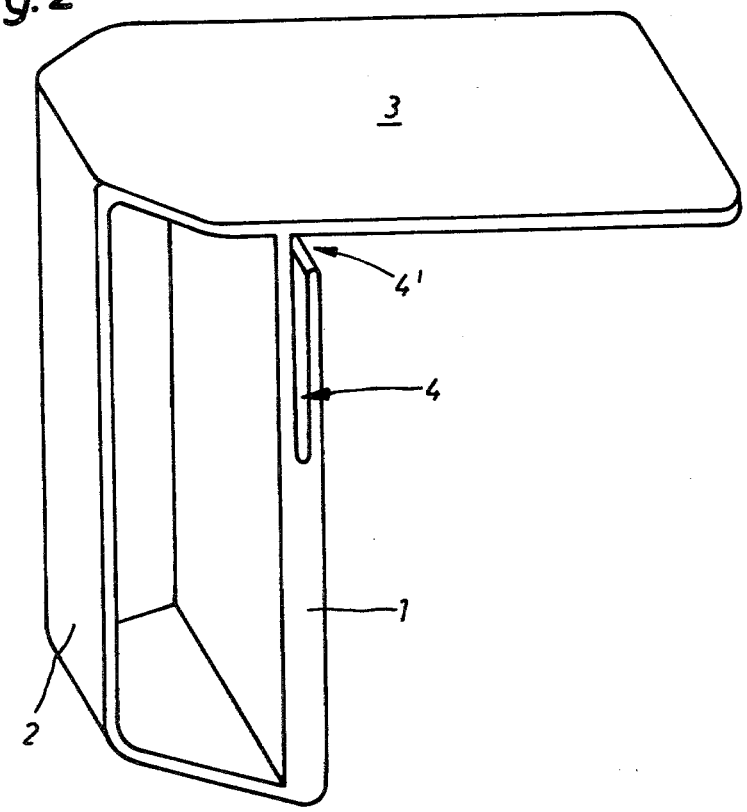
FIG. 2 is a perspective view of a preferred embodiment.

FIG. 2 of the drawings shows a holder according to this invention, and from this figure it can be clearly seen that thanks to the particularly thin-walled strip or lug 4', one of the container flaps remains virtually in its original position (it has been only very slightly pulled away from the container wall).

If the closing flaps 5 should happen to be folded back on the topside of the container, the flap which must be pushed into the slot 4 would merely have to be turned over about the fold line and inserted into the slot 4 as described in order to fulfill its function in association with the described holder.

Basically it would also be conceivable to arrange the holder slot on the inside of the upper supporting element.

Figure 3:
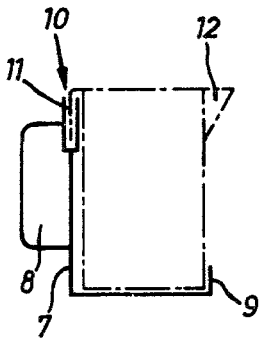
FIGS. 3 to 5 show, purely schematically, further embodiments of holders according to this invention for rectangular box-shaped drinks containers.
Figure 4:
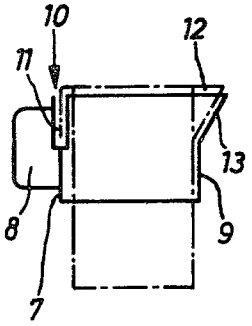
Figure 5:
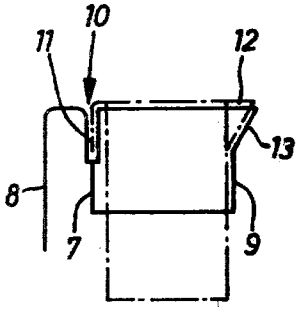

FIGS. 3 to 5 of the drawings illustrate in a purely schematic fashion some further examples of holders for rectangular box-shaped drinks packages which are closed by means of the conventional closing flaps folded back against front and rear walls of the container.

It will be seen that the holders comprise a rearwall supporting element 7, a handle part 8 rigidly connected or integrally formed therewith, and a frontwall supporting element 9. At the upper end of the rear-wall supporting element 7 there is provided a recess 10 in the form of a slot into which the flap 11 (dotted lines) can be easily inserted after having been lightly pulled away from the container walls. This basic construction guarantees a secure and firm hold of the container in the holder and allows the liquid contents to be poured out through the opened flap 12. The container may be readily tilted into a horizontal position without any fear of dropping out of its holder.

The holder shown in FIGS. 4 and 5 consists essentially of a tubular element, that is to say, that it has no base or bottom wall, permits its application to drinks containers of different heights. A holder according to this embodiment of the invention may also be provided with a pouring spout 13.

FIG. 6 shows a holder which is also of tubular shape, and it will be seen that thanks to the particularly thin-walled strip or lug 14, the flap 11 remains virtually in its original position (it has merely been pulled slightly away from the container wall).

If the closing flaps 11 should be folded back on the topside of the package, the flap which is to be inserted into the slot 10 could be just turned over about the fold line and inserted into the slot 10 as described to fulfill its function in association with the described holder.

Figure 7:
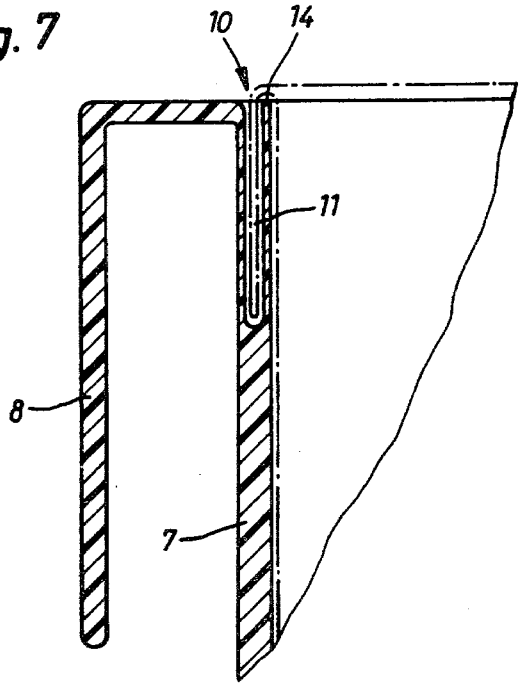
FIG. 7 is a fragmentary vertical section through the upper region of the rear-wall-supporting element of the holder shown in FIG. 6.

FIG. 7 shows a detail of the holder according to FIG. 6. The recess 10 may here be of substantially rectangular shape, or, for example, it may be triangular to match the configuration of the flap 11.

What is claimed is:

1. A detachable container holder for liquid packaging containers having upstanding front and rear walls, side walls extending between said front and rear walls and end margins of said side, front and rear walls defining flaps infolded into overlapping relationship to form an end closure of the container, wherein said holder incorporates a first supporting element arranged to lie at least partly along the rear wall of the container, handle means associated with said first supporting element, a further supporting element integral with said first supporting element and being arranged to engage a further portion of the container, and retaining means provided on one of said supporting elements and arranged to receive and retain the flap defined by the upper end margin of the container end wall when said flap is pried away from the infolded closed position.

2. A holder as claimed in claim 1, wherein the retaining means is a slot dimensioned to accommodate said flap.

3. A holder as claimed in claim 2, wherein the further supporting element is spaced from the first supporting element and extends substantially parallel thereto, said first and further supporting elements being interconnected and the spacing therebetween being such that the further supporting element will lie at least partly along the front wall of the container.

4. A holder as claimed in claim 2, wherein the further supporting element extends substantially at right angles with respect to the first supporting element at least partially to overlie the infolded upper margins of the container side walls.

5. A holder as claimed in claim 4, wherein the integral first and further supporting elements together encompass the girth of the container with said first supporting element lying at least partly along the container rear wall and the further supporting element at least partly overlying the container side and front walls.

6. A holder as claimed in claim 5, wherein a portion of the further supporting element disposed diametrically opposite the first supporting element is shaped to define a pouring spout.

7. A holder as claimed in claim 4 or claim 3, wherein the flap receiving slot is provided in the upper part of the first supporting element and extends from an opening below, but spaced from the further supporting element downwardly part way along the length of said first supporting element.

8. A holder as claimed in claim 7, wherein the slot is a recess in the first supporting element.

9. A holder according to claim 2 or 4, wherein the said slot is arranged on that side of the supporting element which faces the container to be supported thereby and comprises, additionally to the slot opening proper, at least one further lateral opening designed to facilitate a lateral introduction of the container flap into the slot.

* * * * *